US011867187B2

(12) United States Patent
Yasuda

(10) Patent No.: US 11,867,187 B2
(45) Date of Patent: Jan. 9, 2024

(54) VACUUM PUMP INCLUDING A COVER, COVERING THE BASE WITH AN AIR INSULATING LAYER

(71) Applicant: SHIMADZU CORPORATION, Kyoto (JP)

(72) Inventor: Tomoki Yasuda, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 17/701,206

(22) Filed: Mar. 22, 2022

(65) Prior Publication Data

US 2022/0316485 A1 Oct. 6, 2022

(30) Foreign Application Priority Data

Apr. 1, 2021 (JP) ..... 2021-062845

(51) Int. Cl.
*F04D 19/04* (2006.01)
*F04D 29/58* (2006.01)
*F04D 25/06* (2006.01)

(52) U.S. Cl.
CPC ..... *F04D 19/042* (2013.01); *F04D 19/044* (2013.01); *F04D 25/0606* (2013.01); *F04D 29/584* (2013.01); *F04D 29/5853* (2013.01)

(58) Field of Classification Search
None
See application file for complete search history.

(56) References Cited

U.S. PATENT DOCUMENTS 5,971,725 A * 10/1999 de Simon ..... F04D 25/068 417/423.4
2012/0034066 A1* 2/2012 Kogame ..... F04D 19/042 415/90
2015/0345499 A1 12/2015 Tsubokawa
2018/0245603 A1* 8/2018 Watanabe ..... F04D 29/706
2018/0279415 A1* 9/2018 Moriyama ..... F04D 29/582
2019/0120237 A1* 4/2019 Shiba ..... F04D 19/042
2019/0242386 A1* 8/2019 Shimizu ..... F04D 19/044
2019/0242387 A1* 8/2019 Saegusa ..... F04D 19/04
2019/0309760 A1* 10/2019 Omori ..... F04D 19/042
2019/0383296 A1* 12/2019 Hashimoto ..... F04D 19/042

FOREIGN PATENT DOCUMENTS

JP 2015-229936 A 12/2015
JP 2018-162725 A 10/2018

* cited by examiner

*Primary Examiner* — Bryan M Lettman
*Assistant Examiner* — Geoffrey S Lee
(74) *Attorney, Agent, or Firm* — Renner, Otto, Boisselle & Sklar LLP

(57) ABSTRACT

A vacuum pump comprises: a rotor cylindrical portion; a motor configured to rotate the rotor cylindrical portion; a stator cylindrical portion, the rotor cylindrical portion and the stator cylindrical portion together forming a screw groove pump; a base housing the rotor cylindrical portion and the stator cylindrical portion; a heater configured to heat the base or the stator cylindrical portion; a cooling device attached to the base; and a cover member arranged at an outer peripheral side of the stator cylindrical portion and an outer peripheral side of the base, covering the base through an air insulating layer, and contacting the cooling device.

6 Claims, 2 Drawing Sheets

VACUUM PUMP INCLUDING A COVER, COVERING THE BASE WITH AN AIR INSULATING LAYER

BACKGROUND OF THE INVENTION

1. Technical Field

The present invention relates to a vacuum pump.

2. Background Art

For, e.g., a semiconductor manufacturing device performing CVD film formation or etching, a vacuum pump such as a turbo-molecular pump has been used. Such a vacuum pump has problems such as interference with rotation of a rotor or the necessity of overhaul within a short period of time due to adherence of a product to the inside of the vacuum pump. For coping with these problems, the temperature of a portion contacting gas in the pump is increased to a high temperature to prevent adherence of a reactive product (see, e.g., Patent Literature 1 (JP-A-2015-229936), Patent Literature 2 (JP-A-2018-162725)).

SUMMARY OF THE INVENTION

Of the vacuum pump, a stator cylindrical portion of a screw groove pump has a particularly-high temperature. The outer periphery of a housing which houses such a portion also has a high temperature. There is a need to avoid the risk of a user touching such a high-temperature portion.

A vacuum pump comprises: a rotor cylindrical portion; a motor configured to rotate the rotor cylindrical portion; a stator cylindrical portion, the rotor cylindrical portion and the stator cylindrical portion together forming a screw groove pump; a base housing the rotor cylindrical portion and the stator cylindrical portion; a heater configured to heat the base or the stator cylindrical portion; a cooling device attached to the base; and a cover member arranged at an outer peripheral side of the stator cylindrical portion and an outer peripheral side of the base, covering the base through an air insulating layer, and contacting the cooling device.

A vacuum pump of the present disclosure includes a cover member arranged at an outer peripheral side of a stator cylindrical portion and an outer peripheral side of a base and covering the base through an air insulating layer. Thus, the risk of a user touching a high-temperature portion can be avoided with a simple configuration.

DETAILED DESCRIPTION OF THE EXEMPLARY EMBODIMENTS

First Embodiment

(1) Configuration of Vacuum Pump 1

A vacuum pump 1 of a first embodiment includes a turbo-molecular pump and a screw groove pump. The vacuum pump 1 is connected to an exhaust target device including an exhaust target space. Gas from the exhaust target space is discharged by the turbo-molecular pump, and thereafter, is discharged by the screw groove pump. Then, the gas is discharged to the outside of the vacuum pump 1.

Figure 1:
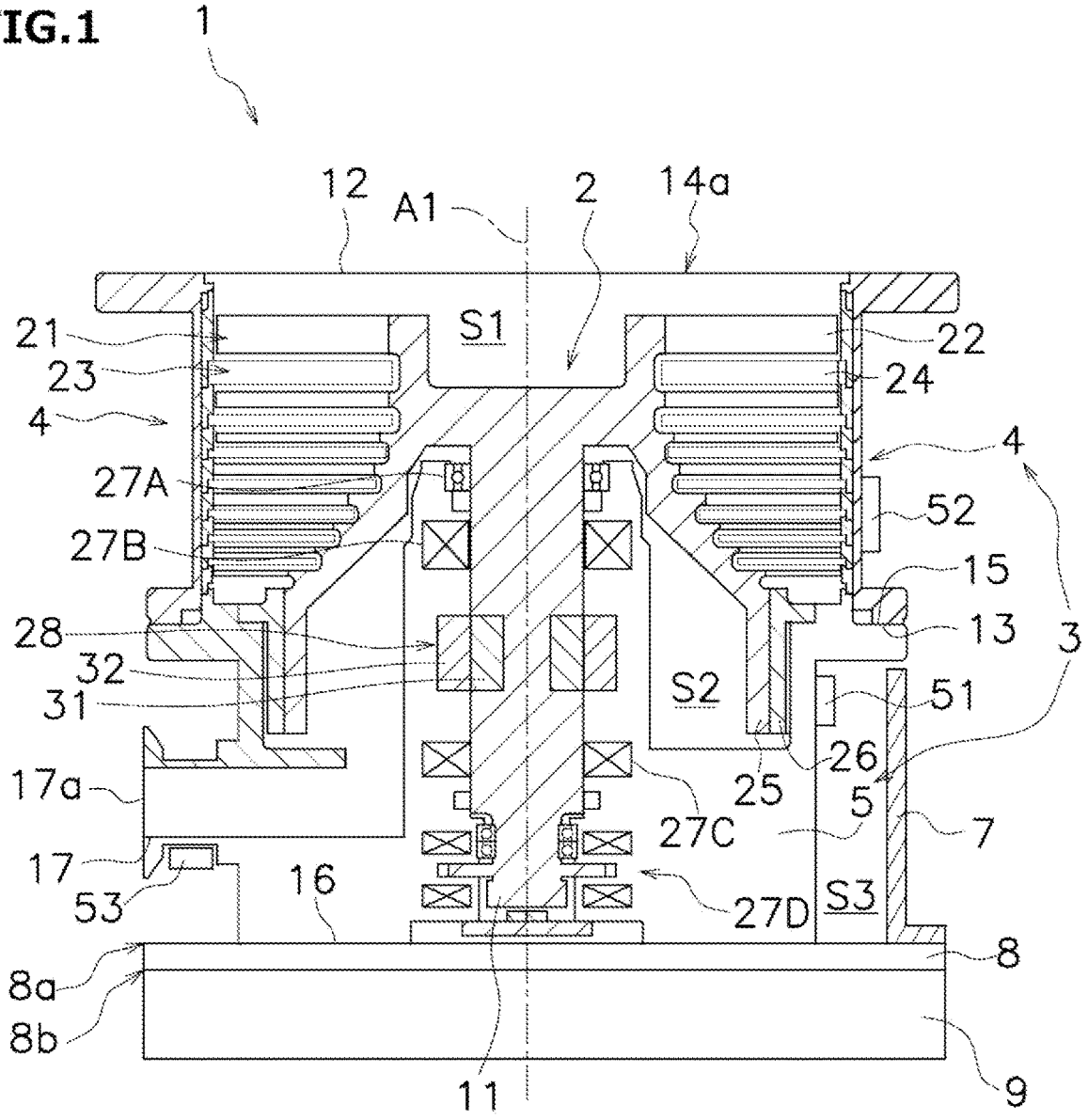
FIG. 1 is a sectional view of a vacuum pump 1 of a first embodiment.

As shown in FIG. 1, the vacuum pump 1 includes a housing 3, a rotor 2, a motor 28, multiple stator blade units 23, a stator cylindrical portion 26, heaters 51 to 53, a cooling device 8, a power supply device 9, and a cover member 7. The housing 3 houses the rotor 2, the motor 28, the multiple stages of the stator blade units 23, and the stator cylindrical portion 26. The cooling device 8 is arranged such that one surface 8*a* contacts the housing 3. The other surface 8*b* of the cooling device 8 is arranged to contact the power supply device 9. The cover member 7 is arranged at an outer peripheral portion of the housing 3 to cover the housing 3 through an air insulating layer S3.

The housing 3 includes a case 4 and a base 5.

The case 4 houses multiple stages of rotor blade units 21 and the multiple stages of the stator blade units 23. The case 4 has a first end portion 12 and a second end portion 13. A first internal space S1 is formed inside the case 4. A suction port 14*a* is formed at the first end portion 12. The first end portion 12 is attached to the exhaust target device. The first internal space S1 communicates with the suction port 14*a*. The second end portion 13 is positioned opposite to the first end portion 12 in an axial direction A1 of the rotor 2. The second end portion 13 is connected to the base 5.

The base 5 houses a rotor cylindrical portion 25 and the stator cylindrical portion 26. The base 5 has a first base end portion 15, a second base end portion 16, and an exhaust pipe 17. The base 5 forms a second internal space S2. The first base end portion 15 is connected to the second end portion 13 of the case 4. The second base end portion 16 is arranged to contact one surface 8*a* of the cooling device 8. The second internal space S2 communicates with the first internal space S1 of the case 4. The exhaust pipe 17 forms an exhaust port 17*a*. The exhaust port 17*a* communicates with the second internal space S2.

Gas (gas molecules) having flowed into the vacuum pump 1 from the exhaust target space enters the first internal space S1 through the suction port 14*a*. The gas reaches the second internal space S2 from the first internal space S1 through the turbo-molecular pump and the screw groove pump. The gas is discharged to the outside of the vacuum pump 1 from the second internal space S2 through the exhaust port 17*a*.

The rotor 2 includes a shaft 11, the multiple stages of the rotor blade units 21, and the rotor cylindrical portion 25.

The shaft 11 extends in the axial direction A1 of the rotor 2. In description below, in the axial direction A1, a direction from the case 4 toward the base 5 is defined as a lower side, and the opposite direction thereof is defined as an upper side.

The vacuum pump 1 further includes multiple bearings 27A to 27D. The multiple bearings 27A to 27D are attached to the base 5. The multiple bearings 27A to 27D rotatably support the rotor 2. The multiple bearings 27A to 27D include magnetic bearings, for example. Note that the multiple bearings 27A to 27D may include other types of bearings such as ball bearings.

The motor 28 rotatably drives the rotor 2. The motor 28 includes a motor rotor 31 and a motor stator 32. The motor rotor 31 is attached to the shaft 11. The motor stator 32 is attached to the base 5. The motor stator 32 is arranged to face the motor rotor 31.

The multiple rotor blade units 21 are connected to the shaft 11. The multiple stages of the rotor blade units 21 are arranged at intervals in the axial direction A1. Each rotor blade unit 21 includes multiple rotor blades 22. Although not shown in the FIGURE, the multiple rotor blades 22 radially extend about the shaft 11. Note that in the FIGURE, reference numerals are assigned only to one of the multiple rotor blade units 21 and one of the multiple rotor blades 22 and reference numerals for the other rotor blade units 21 and the other rotor blades 22 are omitted.

The multiple stages of the stator blade units 23 are connected to an inner surface of the case 4. The multiple stages of the stator blade units 23 are arranged at intervals in the axial direction A1. Each stator blade unit 23 is arranged adjacent ones of the multiple stages of the rotor blade units 21. Each stator blade unit 23 includes multiple stator blades 24. Although not shown in the FIGURE, the multiple stator blades 24 radially extend about the shaft 11.

The multiple stages of the rotor blade units 21 and the multiple stages of the stator blade units 23 form the turbomolecular pump. Note that in the FIGURE, reference numerals are assigned only to one of the multiple stator blade units 23 and one of the multiple stator blades 24 and reference numerals for the other stator blade units 23 and the other stator blades 24 are omitted.

The rotor cylindrical portion 25 is arranged below the rotor blade units 21. The rotor cylindrical portion 25 extends in the axial direction A1.

The stator cylindrical portion 26 is arranged outside the rotor cylindrical portion 25 in a radial direction. The stator cylindrical portion 26 is connected to the base 5. The stator cylindrical portion 26 is, in the radial direction of the rotor cylindrical portion 25, arranged to face the rotor cylindrical portion 25. A spiral groove is provided at an inner peripheral surface of the stator cylindrical portion 26. A spiral groove may be provided at an outer peripheral surface of the rotor cylindrical portion 25. The rotor cylindrical portion 25 and the stator cylindrical portion 26 form the screw groove pump.

The power supply device 9 controls the motor 28, the magnetic bearings 27A, 27D, and/or the heaters 51 to 53. The power supply device 9 converts, as necessary, power supplied from an external power supply to supply the converted power to the motor 28, the magnetic bearings 27A, 27D, and/or the heaters 51 to 53. The power supply device 9 includes a power supply case, a processor housed in the power supply case, an AC-DC converter, a DC-DC converter, an inverter, a DC power supply, and/or an excitation amplifier. The power supply device 9 generates heat, and for this reason, is cooled by the cooling device 8. The power supply case of the power supply device 9 is arranged in contact with the lower surface 8*b* of the cooling device 8.

The cooling device 8 is made of a metal material. An example of the metal material is an aluminum material. The cooling device 8 includes a refrigerant path allowing circulation of a liquid refrigerant. The liquid refrigerant is water, for example. The cooling device 8 may be formed by casting of a metal pipe. The metal pipe is a copper pipe, for example. The cooling device 8 is attached to the second base end portion 16 of the base 5. The cooling device 8 has the upper surface 8*a* and the lower surface 8*b*. The lower surface 8*b* is arranged in contact with the power supply device 9. The cooling device 8 cools the power supply device 9. The upper surface 8*a* is arranged in contact with the base 5 and the cover member 7. The cooling device 8 cools the base 5 and the cover member 7. The outer diameter of the upper surface 8*a* of the cooling device 8 is greater than the outer diameter of a lower end surface of the base. An attachment portion for attaching the cover member 7 is provided on the upper surface 8*a* of the cooling device 8.

The first heater 51 is placed at the outer periphery of the base 5. Alternatively, the first heater 51 may be placed to be directly contacted with the stator cylindrical portion 26. The first heater 51 heats the outer periphery of the base 5 and the stator cylindrical portion 26.

The second heater 52 is arranged at the outer periphery of the case 4 at the outer periphery of the multiple stages of the stator blade units 23. The second heater 52 heats the multiple stages of the stator blade units 23.

The third heater 53 is arranged at the outer periphery of the exhaust pipe 17. The third heater 53 heats the exhaust pipe 17. The temperature of heating by the third heater is higher than the temperatures of heating by the first and second heaters.

In a gas path of the vacuum pump 1, the multiple stages of the stator blade units 23, the stator cylindrical portion 26, a portion of the base 5 facing the second internal space S2, the exhaust pipe 17, and the like are heated using the heaters for preventing gas adherence in some cases. Specifically, portions other than the multiple stages of the stator blade units 23 are heated to a higher temperature. For outer peripheral portions of the multiple stages of the stator blade units 23, i.e., the vicinity of an outer peripheral portion of the case 4, not only the second heater 52 but also a cooling section are arranged for temperature control. The outside of the base 5 is at a high temperature. The external temperature of the base 5 reaches about 100° C. There is a probability that a user gets burned when a user's hand touches the base 5. For this reason, in the present embodiment, the cover member 7 is arranged for avoiding the risk of the user contacting the high-temperature outer peripheral portion of the base 5.

The cover member 7 is arranged at the housing 3, specifically at an outer peripheral side of the base 5 and an outer peripheral side of the stator cylindrical portion 26. That is, the cover member 7 is arranged to surround the base 5 and the stator cylindrical portion 26. Thus, the cover member 7 can prevent the user (an operator) from touching the high-temperature base 5. The cover member 7 is arranged through the air insulating layer S3, and does not directly contact the housing 3, specifically the base 5. This can favorably prevent the cover member 7 from having a high temperature due to transmission of heat of the stator cylindrical portion 26 and the base 5 to the cover member 7 directly or by heat radiation. The arrangement position of the cover member 7 is below the first base end portion 15. The cover member 7 is arranged in contact with the upper surface 8*a* of the cooling device 8. The cover member 7 is fixed to the cooling device 8. Thus, the cover member 7 is cooled by the cooling device 8. This can more favorably prevent the cover member 7 from having a high temperature. In the present embodiment, the outer diameters of the cooling device 8 and the power supply device 9 are greater than the outer diameter of the base 5, and therefore, the attachment portion for attaching the cover member 7 is formed on the upper surface 8*a* of the cooling device 8. That is, the cooling device 8 protrudes outwardly from the base 5 in the radial direction, and such a protruding region forms the attachment portion. The cover member 7 is attached to the attachment portion.

Figure 2A:
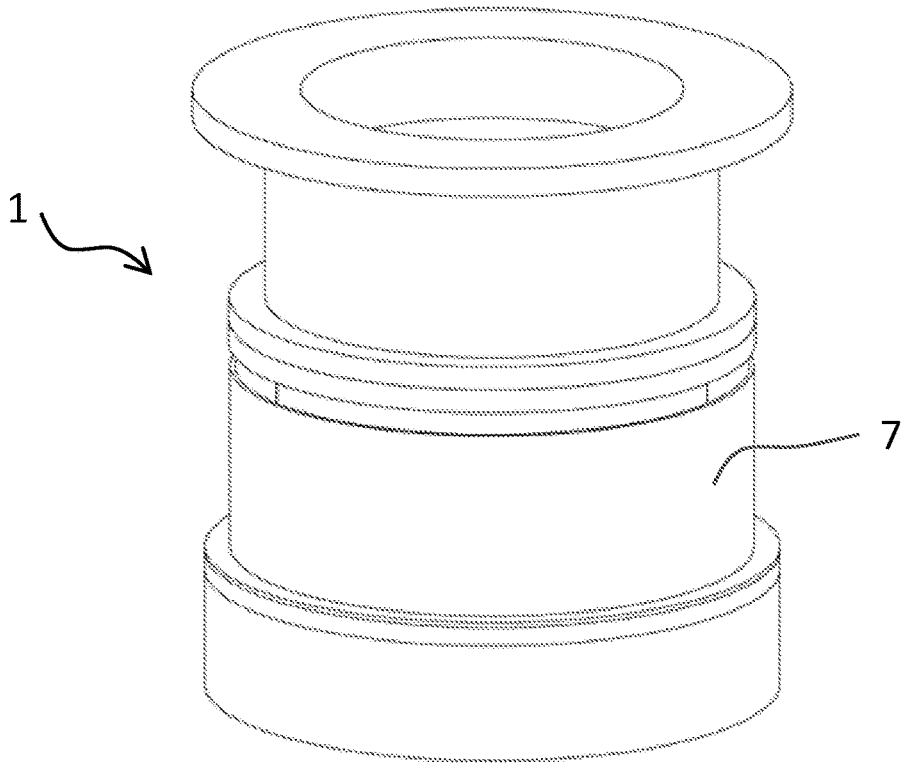
FIG. 2A is a perspective view of a vacuum pump 1 with a tubular (cylindrical) cover member 7.
Figure 2B:
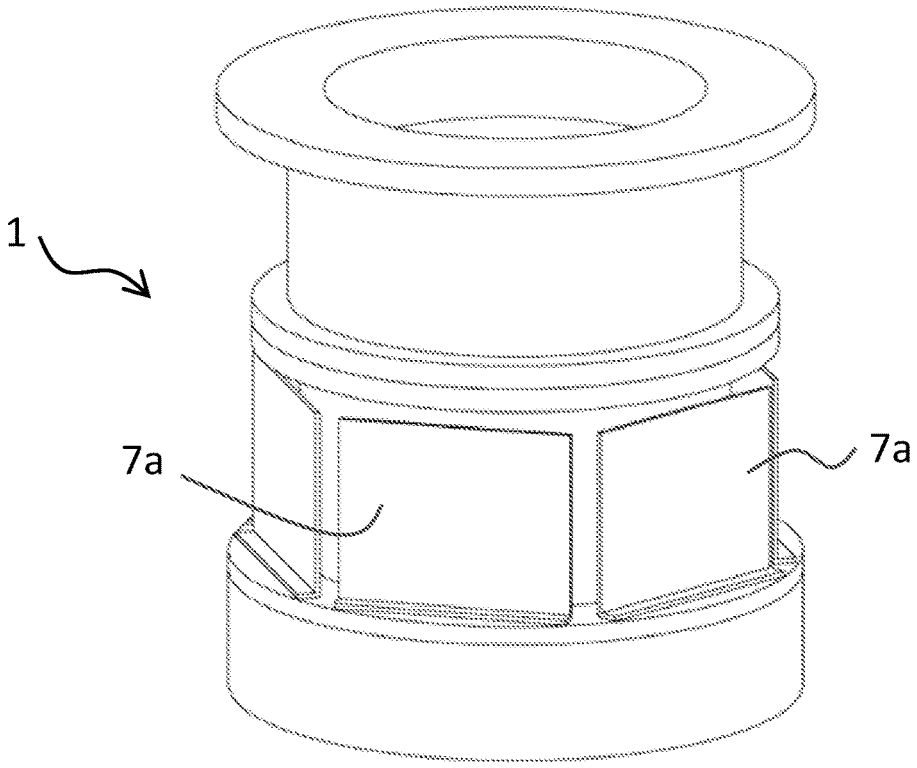
FIG. 2B is a perspective view of a vacuum pump 1 with a cover member 7 made up of plate-shaped members 7*a*.

The cover member 7 is formed in a tubular shape as shown in FIG. 2A at the outer periphery of the tubular (e.g., cylindrical) base 5, and as viewed in plane, is formed in a polygonal shape (e.g., a regular octagonal shape although not specifically limited). Note that the cover member 7 cannot be provided at such a position that the exhaust pipe 17 is arranged, and for this reason, is not in a complete tubular shape. The cover member 7 may be formed in such a manner that a single plate is bent or multiple rectangular plate-shaped members are combined. For example, the cover member 7 may be formed in such a manner that two to four plate-shaped members 7*a* formed by bending of flat plates at predetermined angles are combined, as illustrated in FIG. 2B. Thus, production of the cover member 7 is easy, and the cost therefor is low. The thickness of the plate forming the cover member is equal to or greater than 1 mm and equal to or less than 10 mm. The material of the cover member is metal or plastic. Metal is preferred, considering the easiness of processing.

At a portion where the outer periphery of the base 5 and the cover member 7 are most adjacent to each other, the thickness of the air insulating layer is preferably equal to or greater than 1 mm, more preferably equal to or greater than 3 mm, and much more preferably equal to or greater than 10 mm. Moreover, at the portion where the outer periphery of the base 5 and the cover member 7 are most adjacent to each other, the thickness of the air insulating layer is preferably equal to or less than 100 mm and more preferably equal to or less than 50 mm. If the thickness of the air insulating layer is too small, heat insulation performance is not sufficient. If the thickness is too great, the vacuum pump 1 is increased in size.

The vacuum pump 1 according to the above-described embodiment is a combination pump configured such that the turbo-molecular pump and the screw groove pump are integrated.

However, the turbo-molecular pump may be omitted. That is, the vacuum pump 1 may include only the screw groove pump.

Second Embodiment

(2) Configuration of Vacuum Pump of Second Embodiment

A vacuum pump 1 of a second embodiment does not have the second heater 52 of the first embodiment, and instead, has a fourth heater configured to heat a stator cylindrical portion 26. Other configurations of the vacuum pump 1 are similar to those of the first embodiment.

In the vacuum pump 1 of the second embodiment, the outer periphery of a base 5 is also at a high temperature. Thus, a cover member 7 can avoid, as in the vacuum pump 1 of the first embodiment, the risk of a user touching a high-temperature portion.

The multiple embodiments of the present disclosure have been described above, but the present disclosure is not limited to the above-described embodiments and various changes can be made without departing from the gist of the present disclosure. The multiple embodiments described in the present specification can be combined as necessary.

(3) Aspects

Those skilled in the art understand that the above-described multiple exemplary embodiments are specific examples of the following aspects.

(First Aspect)

A vacuum pump comprises: a rotor cylindrical portion; a motor configured to rotate the rotor cylindrical portion; a stator cylindrical portion, the rotor cylindrical portion and the stator cylindrical portion together forming a screw groove pump; a base housing the rotor cylindrical portion and the stator cylindrical portion; a heater configured to heat the base or the stator cylindrical portion; a cooling device attached to the base; and a cover member arranged at an outer peripheral side of the stator cylindrical portion and an outer peripheral side of the base, covering the base through an air insulating layer, and contacting the cooling device.

A vacuum pump according to a first aspect is configured such that a cover member covers an outer peripheral side of a base at an outer peripheral side of a stator cylindrical portion, and therefore, the risk of a user touching the base as a high-temperature portion can be avoided. The cover member covers the base through an air insulating layer, and is not directly connected to the base. This can favorably prevent the cover member from having a high temperature. Since the cover member is not connected to the base, a heat insulation component for preventing transmission of heat of the base to the cover member does not need to be provided, and a cost and the number of components can be reduced. Further, the cover member is attached to a cooling device, and is cooled by the cooling device. This can more favorably prevent the cover member from having a high temperature. As a result, the risk of the user touching the high-temperature portion can be more favorably avoided.

(Second Aspect)

The vacuum pump further comprises: a power supply device configured to supply power to the motor. The power supply device is arranged in contact with the cooling device, and the base and the cover member are arranged in contact with a surface of the cooling device opposite to a surface contacting the power supply device.

A vacuum pump according to a second aspect has a power supply device, and a cooling device cools both of the power supply device and a cover member. Thus, the risk of a user touching a high-temperature portion can be reduced with a simple configuration.

(Third Aspect)

The cooling device is attached to a lower end surface of the base, an outer diameter of the cooling device is greater than an outer diameter of the lower end surface of the base, and an attachment portion for attaching the cover member is provided on an upper surface of the cooling device, and a lower end of the cover member is attached to the attachment portion.

According to a vacuum pump of a third aspect, a cover member can be stably attached to an upper surface of a cooling device, and can be more favorably cooled.

(Fourth Aspect)

The vacuum pump further comprises multiple stages of rotor blades to be rotated together with the rotor cylindrical portion by the motor; multiple stages of stator blades, the multiple stages of the rotor blades and the multiple stages of the stator blades together forming a turbo-molecular pump; and a case housing the multiple stages of the rotor blades and the multiple stages of the stator blades.

According to a vacuum pump of a fourth aspect, an upstream-side case and a downstream-side base form a housing of the vacuum pump. In addition, a cover member is provided to cover at least the outer periphery of the base. The vacuum pump has such a structure that a cooling device is connected to the base and the cover member is connected to the cooling device.

(Fifth Aspect)

The cover member is formed in a tubular shape from one or more plate-shaped members formed by bending of one or more flat plates.

According to a vacuum pump of a fifth aspect, a cover member is formed in such a manner that a flat plate is bent, and therefore, production of the cover member is easy and the cost therefor is low.

(Sixth Aspect)

An outer periphery of the base is in a tubular shape, and the cover member is in a tubular shape, and at a portion where the outer periphery of the base and the cover member are most adjacent to each other, a thickness of the air insulating layer is equal to or greater than 1 mm and equal to or less than 100 mm.

In a vacuum pump according to a sixth aspect, the thickness of an air insulating layer is equal to or greater than 1 mm, and therefore, the outer periphery of a base and a cover member are thermally insulated from each other. The thickness of the air insulating layer is equal to or less than 100 mm, and therefore, an excessive increase in the size of the vacuum pump can be avoided.

What is claimed is:

1. A vacuum pump comprising:

a rotor cylindrical portion;

a motor configured to rotate the rotor cylindrical portion;

a stator cylindrical portion, the rotor cylindrical portion and the stator cylindrical portion together forming a screw groove pump;

a base housing the rotor cylindrical portion and the stator cylindrical portion;

a heater configured to heat the base or the stator cylindrical portion to prevent gas adherence;

a cooling device attached to the base; and a cover member arranged at an outer peripheral side of the stator cylindrical portion and an outer peripheral side of the base, wherein the cover member covers the base through an air insulating layer so that the cover member is not in direct contact with the base, the cover member is in direct contact with the cooling device so that the cover member is cooled by the cooling device, and the cover member surrounds the base to prevent a user contacting a high-temperature outer peripheral portion of the base.

2. The vacuum pump according to claim 1, further comprising:

a power supply device configured to supply power to the motor, wherein the power supply device is arranged in contact with the cooling device, and the base and the cover member are arranged in contact with a surface of the cooling device opposite to a surface contacting the power supply device.

3. The vacuum pump according to claim 1, wherein the cooling device is attached to a lower end surface of the base, an outer diameter of the cooling device is greater than an outer diameter of the lower end surface of the base, and an attachment portion for attaching the cover member is provided on an upper surface of the cooling device, and a lower end of the cover member is attached to the attachment portion.

4. The vacuum pump according to claim 1, further comprising:

multiple stages of rotor blades to be rotated together with the rotor cylindrical portion by the motor;

multiple stages of stator blades, the multiple stages of the rotor blades and the multiple stages of the stator blades together forming a turbo-molecular pump; and a case housing the multiple stages of the rotor blades and the multiple stages of the stator blades.

5. The vacuum pump according to claim 1, wherein the cover member is formed in a tubular shape from one or more plate-shaped members formed by bending of one or more flat plates.

6. The vacuum pump according to claim 1, wherein an outer periphery of the base is in a tubular shape, and the cover member is in a tubular shape, and at a portion where the outer periphery of the base and the cover member are most adjacent to each other, a thickness of the air insulating layer is equal to or greater than 1 mm and equal to or less than 100 mm.

* * * * *